United States Patent [19]

Bell, Jr.

[11] Patent Number: 4,983,072

[45] Date of Patent: Jan. 8, 1991

[54] METHOD OF PROTECTING SUBMERGED PILING

[76] Inventor: Henry A. Bell, Jr., 5484 Pensacola Ave., Orange Beach, Ala. 36561

[21] Appl. No.: 385,104

[22] Filed: Jul. 26, 1989

[51] Int. Cl.[5] ..... E02D 5/60

[52] U.S. Cl. ..... 405/216; 405/211

[58] Field of Search ..... 405/216, 212, 211, 227, 405/215

[56] References Cited

U.S. PATENT DOCUMENTS

| | | | |
|---|---|---|---|
| 2,308,793 | 1/1943 | Upton | 405/216 |
| 2,874,548 | 2/1959 | Drushel | 405/216 |
| 3,027,610 | 4/1962 | Liddell | 405/216 |
| 3,103,103 | 9/1963 | Liddell | 405/216 |
| 3,141,306 | 7/1964 | Liddell | 405/216 |
| 3,181,300 | 5/1965 | Plummer | 405/216 |
| 3,321,924 | 5/1967 | Liddell | 405/216 |
| 3,372,552 | 3/1968 | Liddell | 114/219 X |
| 3,397,260 | 8/1968 | Lamberton . | |
| 3,417,569 | 12/1968 | Laughlin . | |
| 3,708,146 | 1/1973 | Lamberton . | |
| 3,719,049 | 3/1973 | Shaw et al. . | |
| 3,999,399 | 12/1976 | Maurer | 405/216 X |
| 4,273,833 | 6/1981 | Delong | 405/216 X |
| 4,439,071 | 3/1984 | Roper, Jr. | 405/216 |
| 4,764,054 | 8/1988 | Sutton | 405/216 |

*Primary Examiner*—Dennis L. Taylor
*Assistant Examiner*—J. Russell McBee
*Attorney, Agent, or Firm*—Banner, Birch, McKie & Beckett

[57] ABSTRACT

A method for protecting a wood piling against marine borer attack wherein the piling is surrounded with a flexible sheet of UV-resistant material so as to define an annular space which is filled with a water-insoluble filler material.

3 Claims, 1 Drawing Sheet

METHOD OF PROTECTING SUBMERGED PILING

BACKGROUND OF THE INVENTION

1. Field Of The Invention

This invention relates to a method for protecting submerged wooden structures, such as wood pilings, from attack by marine organisms, such as marine borers. The invention prolongs the life and serviceability of submerged pilings and the like.

2. Description Of Related Art

Wooden piling has been used for many years to support piers, wharves, and for slips and the like. It is well-known that such piling is subject to many hazards necessitating replacement of the piling. One major source of damage is plant and particularly marine life. Certain parasites and microorganisms are particularly troublesome for wooden structures. Marine organisms known as limnoria, gribbles and teredo or shipworms are prevalent in shore waters and commonly infest submerged wooded structures seriously sapping the strength and life of the structures.

Previous efforts to safeguard against these hazards include the impregnation of the structures and/or the coating of their surfaces with special preservatives and protective coatings using materials such as creosote, tar, impervious paint and many others. While these materials do protect against certain hazards, they are quite ineffective with respect to others. More importantly, these chemical treatments are subject to leaching, scaling and erosion by the action of the constantly moving, surrounding water, temperature changes, shock forces and oft repeated application and relief of load forces. The high salinity and other constituents of sea water also contribute to degradation of these protective measures.

Various guard devices also have been proposed for installation about pilings. One prior art protective measure involved enclosing portion of the piling in direct contact with the water with a plastic sheet by wrapping the sheet tightly around the pile. Piling also has been encased with rigid polyvinyl chloride tubing. This method provides a barrier to access by marine life not already present in or on the piling and traps that life present in and on the piling inside the jacket. Rapid depletion of any oxygen present between the protective wrapping and the wood piling deprives marine life of this vital gas and arrests further damage to the piling. While this measure can prove quite effective, prior art techniques for implementing it have proved to be rather cumbersome. Moreover, the jacketing which is intended to wrap tightly around the piling often has a loose set with the result that wave action and other water currents along the shore line causes undesirable wear and often premature failure. Representative of this basic prior art approach are Liddell U.S. Pat. Nos. 3,027,610; 3,103,103; 3,321,924 and 3,372,552; Plummer U.S. Pat. No. 3,181,300 and Maurer U.S. Pat. No. 3,999,399.

DESCRIPTION OF THE INVENTION

The invention broadly pertains to a method for protecting a wooden structure exposed to a marine environment, e.g., which is submerged which is subject to attack and destruction by marine boring pests comprising:

(a) attaching a porous sheet of ultraviolet-resistant material to the surface of said wooden structure exposed to said marine environment to cover said surface and provide a space between said sheet and said surface, said sheet covering said surface from ground level to above high tide line, and (b) substantially filling said space with a water-insoluble filler material that is held in place by said material and resists washing out from said space, said filler material preventing marine boring pests from infesting said wooden structure and suffocating any pests in said wooden structure.

The invention also is directed to a method for protecting wood piling exposed to a marine environment which is subject to attack by marine boring pests comprising:

(a) surrounding said piling with a porous, flexible sheet of UV-resistant material to define an annular space between said sheet and said piling, said sheet having cooperating zippers along vertical edges thereof, which when engaged forms said sheet into an elongated tube, said tube extending along said piling from ground level and preferably from a point below the soil line to at least above high tide line; and (b) substantially filling said annular space with a water-insoluble filler material that is held in place by said tube and resists washing out from said annular space, said filler material preventing marine boring pests from infesting said piling and suffocationg any pests in said piling.

Figure 1:
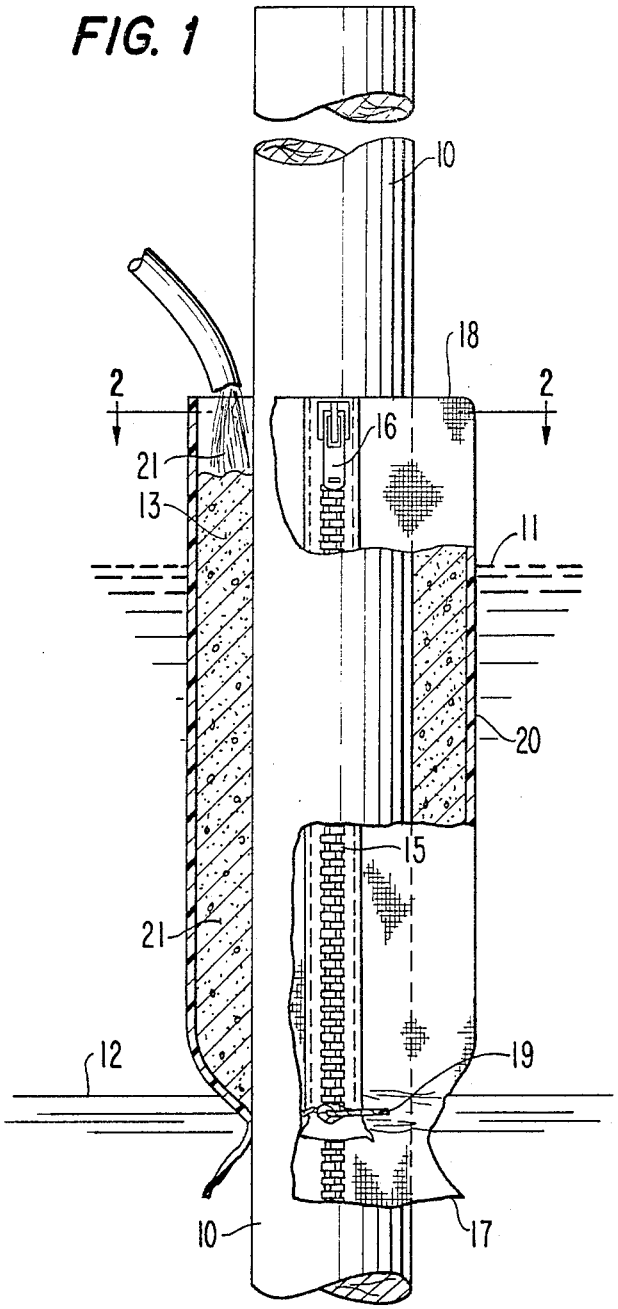
FIG. 1 is a side view partly in cross section of a wooden piling having the protective wrapping of the present invention.
Figure 2:
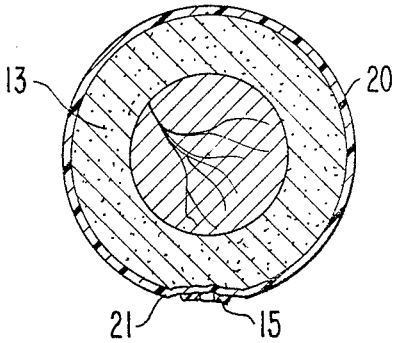
FIG. 2 is a cross sectional view of FIG. 1 taken along line 2—2.

Referring now to the drawings, FIG. 1 shows a vertically extending wood piling 10 extending from above the surface 11 of a body of water, which is shown at high tide level, downwardly under the water to where it is anchored in the ground below, below soil line 12. A porous, flexible sheet of UV-resistant material 20 is wrapped around said wood piling in the shape of an elongated sleeve or tube and is fastened at about ground level 12 to the wood piling 10 and extends upwardly therefrom to a point above about the high tide line 11.

The material sheet forming the sleeve comprises a substantially rectangular shape of porous (cloth-like), pliable material which readily deforms to various shapes without breaking and which is tailored to conform to slightly larger dimensions then the pile to which it is to be applied. The sheet of UV-resistant material 20 is sized so that when wrapped around the wood piling it forms an annular space 13 of a desired thickness. To accomplish this result, the sheet has a width greater than the circumference of the piling a fixed amount such that when it is formed into the sleeve or tube, the diameter of the sleeve or tube so-formed exceeds the diameter of the wood piling 10 by at least an amount equal to twice the desired thickness of the filler material. Thus, the circumference of a piling is normally defined by the formula $\pi d$ where d is the diameter of the column. The width of the sheet should be equal to $\pi(d+2t)$ where t equals the desired thickness of the filler material layer to be placed inside the sleeve. Normally, a thickness (t) of between about 0.5 to 6 inches should be sufficient.

Figure 3:
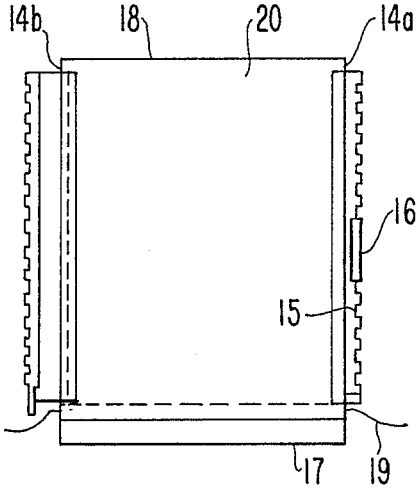
FIG. 3 is an overhead plan view of a sheet of material suitable for forming the protective wrapping of the present invention.

Both vertical edges of the sheet material 14a and 14b (See FIG. 3) are provided with a zipper 15 of conventional construction having a slide 16 which when moved vertically cause the elements of the zipper to innerlock as is well-known. The zipper preferably is made of the same type of material as the sheet of material, preferably a polymeric material or plastic that can withstand long term exposure from the hostile marine environment. The zipper extends from near the lower edge 17 of the sheet of material upwardly to a point usually just short of the upper edge 18.

The lower edge of the sheet of the UV-resistant material formed into the protective sleeve wrapping around the wood piling 10 is anchored firmly to the wood piling. This can be obtained by forming a tube through which a rope, string or other tie back 19 can be threaded to tie the sleeve tightly to the wood piling. Alternatively and usually more conveniently, the tie back can simply be wrapped around the outside of the protective sleeve and secured.

The sleeve is installed about the piling by wrapping the sheet of material 20 around the wood piling and closing the zipper 15 by means of the slide 16. Then, the lower edge of the sleeve is tightly secured to the wood piling by the string or tie back 19. It is desirable to restrain the tie back 19 as tightly as possible to prevent loss of filler material.

In accordance with this invention, the space between the wood piling and the sleeve or tube then is filled with a water-insoluble filler material 21 that resists washing out from the annular space 13 of the sleeve. Preferably, sand or silt available at the site is used as filler material and can be filled or poured into the annular space until the sleeve is substantially and completely filled. Because the filler material 21 is substantially heavier than the surrounding water, hydrostatic pressure created within the sleeve will force excess water therein outwardly through the pores of the sheet material and out of the top of the tube. The filler material must be of a size too large to pass readily through the pores of the material. In other words, hydrostatic pressure causes excess water to be expressed outwardly through the pores of the sleeve and out of the top of the tube and allows the filler material to become tightly packed. The porosity of the sleeve, however, allows the filler material to remain moist which is particularly advantageous when using sand as filler material as it tends to maintain its compacted nature better when wet.

Figure 4:
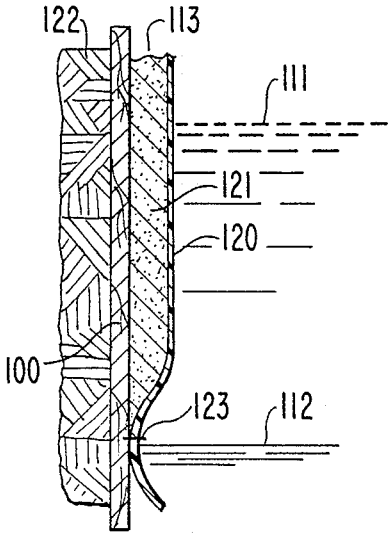
FIG. 4 is a cross sectional view of a wooden retaining wall or bulkhead having the protective wrapping of the present invention.

FIG. 4 shows similar construction for protecting a wooden breaker wall, retaining wall or bulkhead. The exposed (submerged) surface of the wooden retaining wall 100, adapted to hold back the shoreline 122, is covered with a porous, flexible sheet of UV-resistant material 120. The sheet is fastened to the surface of said retaining wall by any suitable means; such as by corrosion resistant nails or hooks 123, to form a space 113 between said sheet and said wall. The sheet covers the wall from below ground level 112 to a point above high tide line 111. The space 113 then is filled with water-insoluble filler material 121.

The protective sheet or sleeve in the FIGS. 1-4 embodiments is designed to remain in place indefinitely to hold filler material against the wall or around the piling. The weight of the filler material also helps to keep the sleeve in place. The destructive marine boring pests, such as shipworms, do not burrow into the soil and thus do not attack wood that is buried in the ground. By this invention, the wood piling is effectively buried in the ground over its entire length subject to the exposure of the harsh marine environment, and thus becomes shielded from such pests.

To facilitate filling said annular space with the filler material, means are provided for holding the upper edge of said sleeve during filing about the piling. Such means can take a number of different forms. For example clips can be secured to the UV-resistant material around the top edge of the sleeve and then anchored, e.g. temporarily, to the pilin using pins or stakes. Alternatively, the sleeve can simply be held manually.

The material used as the sheet to form the sleeve must be able to withstand long term exposure in the hostile marine environment in which it is intended to be used. As used in the specification and claims, a UV-resistant material comprises a material which retains at least 70%, and more preferably at least 80% of its strength under the ultraviolet light and water exposure test as defined by the ASTM-D-4355-84 Test method. One particularly suitable material comprises a strong, porous polypropylene cloth available from Amoco, as Amoco woven construction fabric 1199. Alternatively, other woven construction-type cloths of high strength fibrous materials having small pores also could be used.

While the method of the present invention can be employed in lieu of conventional chemical treatment of wood piling, such as for example using creosote, it preferably is used in addition to the application of creosote. A particularly useful aspect of the present invention is that it can be used to protect wood piles already in place. When used in this matter, it will arrest any marine pest activity which has already taken place and also will prevent any further marine borer attack. The protective sleeve of the present invention also minimizes the leaching of any protective chemicals with which the piling may have been impregnated. Understandably, this greatly extends the surface life of the wood piling.

Depending upon local conditions, the area of the pile which is subject to marine borer attack may extend from way above the high tide line to below the soil or mud line of the body of water. Thus, it often is preferred to use a sufficiently sized sleeve to extend from below the soil line to above the high tide line. The present invention makes it very easy to protect even very long piles against marine borer attack.

While certain specific embodiments of the invention have been described with particularly herein, it will be recognized that various modifications thereof will occur to those skilled in the art, and it is to be included within the purview of this application and the spirit and scope of the appended claims.

I claim:

1. A method for protecting a wooden structure exposed to a marine environment against attack and destruction by marine boring pests comprising:

(a) attaching a porous flexible sheet of ultraviolet-resistant material to a surface of said wooden structure exposed to said marine environment to surround said surface from said marine environment and provide a space between said sheet and said surface, said sheet surrounding said surface from ground level to above high tide line, (b) substantially filling said space with a water-insoluble filler material selected from sand and silt, the filler material being held in place by said porous flexible sheet of ultraviolet-resistant material and resists being washed out from said space, and (c) keeping said porous flexible sheet of ultraviolet-resistant material attached to said surface of said wooden structure so that said filler material is retained in said space to prevent marine boring pests from infesting said wooden structure and suffocate any pests in said wooden structure.

2. A method for protecting a wood piling exposed to a maring environment which is subject to attack by marine boring pests comprising:

(a) surrounding said piling with a porous flexible sheet of UV-resistant material to define an annular space around said piling, said sheet having cooperating zippers along vertical edges thereof which when engaged form said sheet into an elongated tube, said tube extending along said piling at least from about ground level to at least about high tide line;

(b) substantially filling said annular space with a water-soluble filler selected from sand and silt that resists washing out from said annular space, and (c) keeping said porous flexible sheet of UV-resistant material around said piling so that said filler material is retained in said annular space to prevent marine boring pests from infesting said piling.

3. A method for protecting a wooden structure exposed to a marine environment against attack and destruction by marine boring pests comprising:

(a) attaching a porous flexible sheet of ultraviolet-resistant polypropylene cloth to a surface of said wooden structure exposed to said marine environment to surround said surface from said marine environment and provide a space between said sheet and said surface, said sheet surrounding said surface from ground level to above high tide line, (b) substantially filling said space with a water-insoluble filler material selected from sand and silt, the filler material being held in place by said porous flexible sheet of ultraviolet-resistant polypropylene cloth and resists being washed out from said space, and (c) keeping said porous flexible sheet of ultraviolet-resistant polypropylene cloth attached to said wooden structure so that said filler material is retained in said space to prevent marine boring pests from infesting said wooden structure and suffocate any pests in said wooden structure.

* * * * *